United States Patent [19]

Patridge et al.

[11] Patent Number: 5,041,208

[45] **Date of Patent: * Aug. 20, 1991**

[54] PROCESS FOR INCREASING OCTANE AND REDUCING SULFUR CONTENT OF OLEFINIC GASOLINES

[75] Inventors: Randall D. Patridge, West Trenton; Monique A. Schobert, No. Brunswick; Stephen S. Wong, Medford, all of N.J.

[73] Assignee: Mobil Oil Corporation, Fairfax, Va.

[ * ] Notice: The portion of the term of this patent subsequent to Mar. 6, 2007 has been disclaimed.

[21] Appl. No.: 445,098

[22] Filed: Dec. 6, 1989

Related U.S. Application Data

[63] Continuation of Ser. No. 298,799, Jan. 17, 1989, abandoned, which is a continuation of Ser. No. 937,844, Dec. 4, 1986, abandoned.

[51] Int. Cl.[5] ..... C10G 35/06; C10G 35/085

[52] U.S. Cl. ..... 208/138; 208/217; 208/244

[58] Field of Search ..... 208/138, 217, 244

[56] References Cited

U.S. PATENT DOCUMENTS

| | | | |
|---|---|---|---|
| Re. 283,341 | 2/1975 | Wadlinger et al. | 208/120 |
| 3,008,895 | 11/1961 | Hansford et al. | 208/68 |
| 3,130,006 | 4/1964 | Rabo et al. | 23/110 |
| 3,130,007 | 4/1964 | Breck | 23/113 |
| 3,132,089 | 5/1964 | Hass et al. | 208/89 |
| 3,132,090 | 5/1964 | Helfrey et al. | 208/89 |
| 3,159,568 | 12/1964 | Price | 208/89 |
| 3,236,762 | 2/1966 | Rabo et al. | 208/111 |
| 3,267,022 | 8/1966 | Hansford | 208/111 |
| 3,269,934 | 8/1966 | Hansford | 208/111 |
| 3,287,252 | 11/1966 | Young | 208/59 |
| 3,293,192 | 12/1966 | Maher et al. | 252/430 |
| 3,308,069 | 2/1967 | Wadlinger et al. | 252/455 |
| 3,326,761 | 2/1967 | Rabo et al. | 208/111 |
| 3,354,077 | 11/1967 | Hansford | 208/111 |
| 3,392,108 | 7/1968 | Mason et al. | 208/111 |
| 3,402,996 | 9/1968 | Maher et al. | 23/112 |
| 3,449,070 | 6/1969 | McDaniel et al. | 23/111 |
| 3,472,758 | 10/1969 | Stine et al. | 208/59 |
| 3,493,519 | 2/1970 | Kerr et al. | 252/455 |
| 3,523,887 | 8/1970 | Hanson et al. | 208/111 |
| 3,524,809 | 8/1970 | Hansford | 208/111 |
| 3,549,518 | 12/1970 | Mason | 208/111 |
| 3,553,103 | 1/1971 | Burbidge et al. | 208/111 |
| 3,554,899 | 1/1971 | Hansford | 208/111 |
| 3,591,488 | 7/1971 | Eberly et al. | 208/111 |
| 3,617,483 | 11/1971 | Child | 208/59 |
| 3,644,197 | 2/1972 | Kelley et al. | 208/89 |
| 3,644,200 | 2/1972 | Young | 208/120 |
| 3,655,551 | 4/1972 | Hass et al. | 208/59 |
| 3,663,430 | 5/1972 | Morris | 208/111 |
| 3,691,099 | 9/1972 | Young | 252/450 |
| 3,728,251 | 4/1973 | Kelley et al. | 208/89 |
| 3,760,024 | 9/1973 | Cattanach | 585/417 |
| 3,781,199 | 12/1973 | Ward | 208/89 |
| 3,836,454 | 9/1974 | Hansford | 208/111 |
| 3,847,792 | 11/1974 | Berger | 208/60 |
| 3,867,277 | 5/1975 | Ward | 208/111 |
| 3,894,930 | 7/1975 | Hensley Jr. | 209/60 |
| 3,897,327 | 7/1975 | Ward | 208/111 |
| 3,923,640 | 12/1975 | Wight | 208/111 |
| 3,929,672 | 12/1975 | Ward | 252/455 Z |
| 3,937,791 | 2/1976 | Garwood et al. | 423/328 |
| 4,021,331 | 5/1977 | Ciric | 208/111 |
| 4,021,502 | 5/1977 | Plank et al. | 585/533 |
| 4,040,944 | 8/1977 | Kelley et al. | 208/89 |
| 4,054,539 | 10/1977 | Hensley Jr. | 208/111 |
| 4,089,775 | 5/1978 | Berger et al. | 208/217 |
| 4,093,560 | 7/1978 | Kerr et al. | 252/455 |
| 4,097,365 | 6/1978 | Ward | 208/111 |
| 4,191,638 | 3/1980 | Plank et al. | 208/139 |
| 4,218,307 | 8/1980 | McDaniel | 208/120 |
| 4,257,872 | 3/1981 | LaPierre et al. | 208/59 |
| 4,305,808 | 12/1981 | Bowes et al. | 208/111 |
| 4,326,947 | 4/1982 | Sawyer | 208/111 |
| 4,376,699 | 3/1983 | Gardner | 208/217 |
| 4,401,556 | 8/1983 | Bezman et al. | 208/111 |
| 4,419,220 | 12/1983 | LaPierre et al. | 208/111 |
| 4,419,271 | 12/1983 | Ward | 502/65 |
| 4,431,516 | 2/1984 | Baird et al. | 208/111 |
| 4,431,527 | 2/1984 | Miller et al. | 208/254 |
| 4,440,630 | 4/1984 | Oleck et al. | 208/111 |
| 4,456,527 | 6/1984 | Buss et al. | 208/89 |
| 4,456,693 | 6/1984 | Welsh | 502/65 |
| 4,486,296 | 12/1984 | Oleck et al. | 208/111 |
| 4,500,645 | 2/1985 | Fuchikami et al. | 502/65 |
| 4,517,073 | 5/1985 | Ward et al. | 208/111 |
| 4,517,074 | 5/1985 | Ward | 208/111 |
| 4,563,434 | 1/1986 | Ward | 502/66 |
| 4,565,621 | 1/1986 | Ward | 208/111 |
| 4,576,711 | 3/1986 | Ward et al. | 208/111 |
| 4,584,287 | 4/1986 | Ward | 502/65 |
| 4,590,322 | 5/1986 | Chu | 585/417 |
| 4,600,498 | 7/1986 | Ward | 208/111 |
| 4,604,189 | 8/1986 | Derbyshire et al. | 208/111 |
| 4,610,973 | 9/1986 | Ward | 502/65 |
| 4,642,403 | 2/1987 | Hyde et al. | 585/417 |
| 4,777,308 | 10/1988 | LaPierre et al. | 585/267 |
| 4,781,181 | 11/1988 | Angevine et al. | 208/216 |
| 4,820,402 | 4/1989 | Partridge et al. | 208/11 |

FOREIGN PATENT DOCUMENTS

| | | | |
|---|---|---|---|
| 0014291 | 8/1980 | European Pat. Off. | 29/30 |
| 0186479 | 2/1985 | European Pat. Off. | |

*Primary Examiner*—Curtis R. Davis
*Attorney, Agent, or Firm*—Alexander J. McKillop; Charles J. Speciale; Malcolm D. Keen

[57] ABSTRACT

A novel noble metal containing high $SiO_2/Al_2O_3$ ratio large pore zeolite catalyst is used for the direct reforming and desulfurization of olefinic gasolines derived from catalytic cracking processes. The aromatic gasoline obtained from this process has a higher octane rating and is lower in sulfur than the FCC gasoline fraction feed.

20 Claims, No Drawings

PROCESS FOR INCREASING OCTANE AND REDUCING SULFUR CONTENT OF OLEFINIC GASOLINES

This is a continuation of copending application Ser. No. 298,799, filed on Jan. 17, 1989, now abandoned, which is a continuation of copending application Ser. No. 937,844, filed Dec. 4, 1986, and now abandoned.

CROSS-REFERENCE TO RELATED APPLICATIONS

U.S. patent application Ser. No. 534,430, filed Sept. 21, 1983, now abandoned, by Randall D. Partridge et al, is directed to a combined hydrocracking-reforming process.

U.S. patent application Ser. No. 749,144, filed June 26, 1985, now abandoned, by Rene B. LaPierre et al, is directed to a reforming process.

U.S. patent application Ser. No. 413,278, filed Aug. 30, 1982, now abandoned, by Rene B. LaPierre et al, is directed to a reforming process using catalysts prepared from high silica:alumina ratio large-pore zeolites.

BACKGROUND OF THE INVENTION

1. Field of the Invention

This invention relates to a process for increasing the octane number while simultaneously reducing the sulfur content of olefinic gasolines derived from cracking processes, specifically catalytic cracking processes. The process employs a noble metal containing, high $SiO_2/Al_2O_3$ ratio, large pore zeolite catalyst.

2. Discussion of the Prior Art

New regulations requiring reduction of lead in gasoline will lead to the need for higher average gasoline pool octanes. In addition, there is likely to be continued interest in reducing sulfur oxide (SOx) emissions, especially as gasolines derived from fluidized catalytic cracking (FCC) processes are integrated more into the unleaded gasoline pools for use in automobiles equipped with catalytic converters.

The possibility of catalytically reforming FCC naphtha to upgrade a gasoline pool was considered by L. A. Gerritsen, "Catalytic Reforming of FCC Naphtha for Production of Lead-Free Gasoline", Ketjen Symposium, Amsterdam, 1984, the entire disclosure of which is herein incorporated by reference. Such prior art disclosed the processing of a FCC naphtha fraction over a bimetallic Pt-Re catalyst. It was indicated that higher severity and increased throughput conditions of the process resulted in a deterioration of the cycle length of the catalyst in the reformer. As a consequence, the prior art recognized the need to replace conventional catalysts with more stable catalysts.

Many crystalline silicate zeolites are more known to the prior art. However, direct reforming of the olefinic gasolines derived from catalytic cracking, i.e., such as FCC or thermofor catalytic cracking (TCC), of gas oils leads to rapid aging of conventional reforming catalysts due to the relatively high sulfur content (0.05 to 0.5 wt. %) of these gasolines. The olefinic composition of these gasolines also leads to relatively high hydrogen consumptions and corresponding exotherms during the desulfurization necessary prior to reforming with conventional catalysts.

Thus, conventional catalysts, such as those disclosed in U.S. Pat. Nos. 3,293,192; 3,493,519; 3,591,488; 3,691,099; 4,218,307; 3,308,069; 3,402,996; and 4,191,638, the disclosures of each of which are herein expressly incorporated by reference, show the prior art attempts to achieve novel catalysts having desired properties or specialized utilities.

Certain hydrothermally stable catalysts, such as those taught in U.S. Pat. No. 3,493,519, employ an ammonium-Y crystalline aluminosilicate which is calcined in the presence of rapidly flowing steam. The resultant steamed product is base-exchanged with an ammonium salt and treated with a chelating agent capable of combining with aluminum at pH between about 7 and 9. These aluminum-deficient catalysts are reported to exhibit enormously high activity (alpha value).

Other treatments of synthetic faujasite ($NH_4Y$) prepared by ammonium ion-exchange of sodium faujasite are reported in U.S. Pat. No. 3,591,488. These steamed zeolites, after heat treatment, are base-exchanged with cations, such as ammonium ion, and/or metal ions selected from the following groups of the Periodic Table: Groups II-A, I-B to VII-B, VIII, and the rare earth ions with atomic numbers 51 to 71, such as the following metal ions: Mg, Ca, Sr, Ti, V, Cr, Mn, Fe, Co, Ni, Cu, Zn, Y, W, Re, Os, Ir, Pt, Au and Hg, and preferably those ions in Groups II-A, VIII and the rare earths. It has been reported that the use of this procedure removes nearly all alkali metal cations which were present prior to the steam treatment. A final zeolite product having an alkali metal content below about 0.5 wt %, preferably below about 0.2 wt %, is reported. By utilization of the steam treatment procedure, from 0 up to about 98% or more of the original alumina present in the crystalline aluminosilicates may be abstracted. The resultant products had silica-to-alumina mole ratios typically greater than 5 to 10, depending on the nature of the zeolite, preferably greater than 20, and more preferably greater than about 50. However, high silica-to-alumina ratios greater than these values are not disclosed in the prior art.

Additional hydrocarbon conversion processes and catalysts are disclosed in U.S. Pat. Nos. 4,021,331; 4,419,220; and 4,456,527, the disclosures of each of which are herein expressly incorporated by reference.

The problem of sulfur contamination of catalysts has been generally recognized in the prior art, as taught, for example, in U.S. Pat. No. 4,456,527. However, the prior art approached the catalyst contamination problem by employing separate sulfur removal steps to reduce the sulfur content below 500 parts per billion (ppb), preferably less than 250 ppb, more preferably less than 100 ppb, and most preferably less than 50 ppb.

Thus, although the prior art recognized the problems of catalyst contamination associated with high sulfur-containing feedstocks, none of these prior art attempts has permitted direct reforming of an olefinic gasoline derived from FCC or TCC catalytic cracking of gas oils, in which rapid aging of the reforming catalyst due to the relatively high sulfur content of these gasolines is minimized or avoided.

SUMMARY OF THE INVENTION

Applicants have discovered a process wherein direct reforming of olefinic gasolines derived from catalytic cracking of gas oils, such as through FCC or TCC processes, could be accomplished through the use of novel crystalline silicate zeolites of the large pore type, preferably of larger pore Y zeolites.

The present invention is directed to a process for increasing the octane number of an olefinic-containing feedstock comprising contacting the feedstock in a single-stage process with a noble metal-containing crystalline silicate zeolite having a Constraint Index less than 2, and a $SiO_2/Al_2O_3$ ratio no less than 50, under conditions sufficient to yield a product of increased octane number.

DESCRIPTION OF THE PREFERRED EMBODIMENTS

The process of the present invention is directed to the reforming and desulfurization of olefinic gasolines derived from cracking processes, catalytic or otherwise. Without wishing to be limited to any set process, the description of the present invention will be directed to primarily catalytic cracking processes. By utilizing a noble metal-containing large pore, high silica-to-alumina mole ratio zeolite-containing catalyst, the olefinic gasoline may be processed at high temperatures and yield a product having increased octane number and reduce sulfur content.

Reforming

By way of definition, reforming generally means a process of boosting the octane number of a naphtha or gasoline oil to an octane number than is acceptable for use. For example, straight run naphtha from crude oil might have an octane number of 40, too low for use as a gasoline. This unacceptable characteristic may be improved by reforming. The naphtha may also contain an unacceptable level of sulfur, e.g., 50 parts per million (ppm), which is reduced by reforming under conditions set forth in this invention.

Most of today's reforming catalysts, e.g., platinum-on-alumina, require that the sulfur in the fuel oil be reduced to a level of about 0.2 ppm in order for the catalyst to survive. Conventional reformers run at temperatures of between about 900° and 1000° F. (482°-538° C.) and pressures between about 100 and 500 psig. Hydrogen is co-fed with the naphtha in a ratio of about 5:1. In order to keep the conventional reformers operating, small amounts of chlorine, and sometimes water, are co-fed with the hydrocarbon feed in order to keep the catalyst active. Further, most of the hydrocarbon feeds must be hydrotreated prior to reforming in order to reduce the sulphur to a level of about 0.2 ppm. This allows the catalyst not only to survive, but to work optimally.

The requirement for chlorine and for the reduction of sulphur is disadvantageous to the reforming process. Because of this, standard reforming operations cannot be used for olefinic feeds, which are the feedstocks of the present invention.

The present invention has a number of advantages over conventional reforming. First, most of the reforming catalysts are limited to feedstocks having a 350° F. (177° C.) end point in the naphtha feedstock. Any feedstock higher than the 350° F. (177° C.) end point will tend to age the catalyst too rapidly. However, the present catalyst may tolerate much higher end point feedstocks. Secondly, there is no requirement to pass chlorine over the catalyst in order to keep the catalyst active, as the zeolite of the present invention provides the acidity needed for the reaction to take place. Third, there is no requirement to reduce the sulphur content by a pre-hydrotreatment step, as the use of the catalyst of the present invention under conventional reforming conditions both removes sulphur and raises the octane number of the feedstock product.

Feedstock

The feedstock of the present invention is generally a gasoline derived from catalytic cracking or thermocracking. The catalytic cracking process may be either a fluid catalytic cracking (FCC) process or a thermofor catalytic cracking (TCC) process. The feed of the present invention is unique in that it contains sulphur in concentrations greater than about 100 ppm, which normally would have to be hydrotreated in order to allow it to be processed over a conventional reforming catalyst. Further, the feedstock contains olefins, which additionally would require hydrotreatment in order to be passed over a conventional reforming catalyst. Further still, the feedstock of the present invention has a boiling range which exceeds the boiling range of feedstocks conventionally processed over conventional reforming catalysts. Therefore, this type of feed would not normally be processed in a conventional reformer. Normally, it would have to be blended into a gasoline pool, which would then be hydrotreated for further processing.

Catalysts

The preferred catalysts for this invention contain zeolite-type crystals and, most preferably, large pore zeolites have a Constraint Index less than 2, as described hereinafter. For purposes of this invention, the term "zeolite" is meant to represent the class of porotectosilicates, i.e., porous crystalline silicates, that contain silicon and oxygen atoms as the major components. Other components may be present in minor amounts, usually less than 14 mole %, and preferably less than 4 mole %. These components include aluminum, gallium, iron, boron and the like, with aluminum being preferred, and used herein for illustration purposes. The minor components may be present separately or in mixtures in the catalyst. They may also be present intrinsically in the structure of the catalyst.

The framework silica-to-alumina mole ratio referred to may be determined by conventional analysis. This ratio is meant to represent, as closely as possible, the ratio in the rigid anionic framework of the zeolite crystal and to exclude aluminum in the binder or in cationic or other forms within the channels. Although zeolites with a silica-to-alumina mole ratio of at least 10 are useful, it is preferred to use zeolites have much higher silica-to-alumina mole ratios, i.e., ratios of at least 50:1 and preferably greater than about 500:1. In addition, zeolites, as otherwise characterized herein but which are substantially free of aluminum, i.e., having silica-to-alumina mole ratios up to and including infinity, are found to be useful and even preferable in some instances. The novel class of zeolites, after activation, acquire an intra-crystalline sorption affinity for normal hexane, which is greater than that for water, i.e., they exhibit "hydrophobic" properties.

A convenient measure of the extent to which a zeolite provides control to molecules of varying sizes to its internal structure is the Constraint Index of the zeolite. Zeolites which provide a highly restricted access to and egress from its internal structure have a high value for the Constraint Index, and zeolites of this kind usually have pores of small size, e.g., less than 5 Angstroms. On the other hand, zeolites which provide relatively free access to the internal zeolite structure have a low value for the Constraint Index and usually pores of large size, i.e., greater than 8 Angstroms. The method by which Constraint Index is determined is described fully in U.S. Pat. No. 4,016,218, to which reference is made for details of the method.

Constraint Index (CI) values for some typical large pore materials are:

| | CI (At Test Temperature) |
|---|---|
| ZSM-4 | 0.5 (316° C.) |
| ZSM-20 | 0.5 (371° C.) |
| TEA Mordenite | 0.4 (316° C.) |
| Mordenite | 0.5 (316° C.) |
| REY | 0.4 (316° C.) |
| Amorphous Silica-Alumina | 0.6 (538° C.) |
| Dealuminized Y (Deal Y) | 0.5 (510° C.) |
| Zeolite Beta | 0.6-2 (316°-399° C.) |

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby exhibit different Constraint Indices. Constraint Index seems to vary somewhat with severity of operation (conversion) and the presence or absence of binders. Likewise, other variables, such as crystal size of the zeolite, the presence of occluded contaminants, etc., may affect the Constraint Index. Therefore, it will be appreciated that it may be possible to so select test conditions, e.g., temperatures, as to establish more than one value for the Constraint Index of a particular zeolite. This explains the range of Constraint Indices for Zeolite Beta.

Zeolite ZSM-4 is described in U.S. Pat. No. 3,923,639, to which reference is made for details of this catalyst.

Zeolite ZSM-20 is described in U.S. Pat. No. 3,972,983, to which reference is made for details of this catalyst.

Zeolite Beta is described in U.S. Pat. Nos. 3,308,069 and Re. 28,341, to which reference is made for details of this catalyst.

Zeolite Y is described in U.S. Pat. No. 3,130,007, to which reference is made for details of this catalyst.

Low sodium Ultrastable Y molecular sieve (USY) is described in U.S. Pat. Nos. 3,293,192 and 3,449,070, to which reference is made for details of this catalyst.

Dealuminized Y zeolite (Deal Y) may be prepared by the method found in U.S. Pat. No. 3,442,795, to which reference is made for details of this catalyst.

Zeolite UHP-Y is described in U.S. Pat. No. 4,401,556, to which reference is made for details of this catalyst.

The large pore zeolites, i.e., those zeolites having a Constraint Index less than 2, are well known to the art and have a pore size sufficiently large to admit the vast majority of components normally found in a feed chargestock. The zeolites are generally stated to have a pore size in excess of 7 Angstroms and are represented by zeolites having the structure of, e.g., Zeolite Beta, Zeolite L, Zeolite Y, Ultrastable Y (USY), Dealuminized Y (Deal Y), Mordenite, ZSM-3, ZSM-4, ZSM-18, ZSM-20. A crystalline silicate zeolite well known in the art and useful in the present invention is faujasite. The ZSM-20 zeolite resembles faujasite in certain aspects of structure, but has a notably higher silica/alumina ratio than faujasite, as does Deal Y.

Although Zeolite Beta has a Constraint Index less than 2, it is to be noted that it does not have the same structure as the other large pore zeolites, nor does it behave exactly like a large pore zeolite. However, Zeolite Beta does satisfy the requirements for a catalyst of the present invention.

The catalyst should be comprised of a source of acidity, i.e., an alpha value greater than 0.1. The alpha value, a measure of zeolite acidic functionality, is described together with details of its measurement in U.S. Pat. No. 4,016,218 and in *J. Catalysis*, Vol. VI, pp. 278-287 (1966) and reference is made to these for such details. A preferred source of zeolitic acidity is a faujasite or other large pore zeolite which has low acidity (alpha between 1 and 200) due to (a) high silica/alumina ratio, (b) steaming, (c) steaming followed by dealumination, or (d) substitution of framework aluminum by other nonacidic trivalent species. Also of interest are large pore zeolites whose surface acidity has been reduced or eliminated by extraction with bulky reagents or by surface poisoning.

In practicing the process of the present invention, it may be useful to incorporate the above-described crystalline zeolites with a matrix comprising another material resistant to the temperature and other conditions employed in the process. Such matrix material is useful as a binder.

Useful matrix materials include both synthetic and naturally-occurring substances, as well as inorganic materials such as clay, silica and/or metal oxides. The latter may be either naturally-occurring or in the form of gelatinous precipitates or gels including mixtures of silica and metal oxides. Naturally-occurring clays which can be composited with the zeolite include those of the montmorillonite and kaolin families, which families include the sub-bentonites and the kaolins commonly known as Dixie, McNamee-Georgia and Florida clays or others in which the main mineral constituent is haloysite, kaolinite, dickite, nacrite or anauxite. Such clays can be used in the raw state as originally mined or initially subjected to calcination, acid treatment or chemical modification.

In addition to the foregoing materials, the zeolites employed herein may be composited with a porous matrix material, such as alumina, silica, silica-alumina, silica-magnesia, silica-zirconia, silica-thoria, silica-beryllia, and silica-titania, as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix, on an anhydrous basis, may vary widely with the zeolite content range from between 1 to about 99 wt %, and more usually in the range of about 5 to about 80 wt % of the dry composite.

The acidic component of the zeolite is preferably a porous crystalline zeolite. The crystalline zeolite catalysts used in the catalyst comprise a three-dimensional lattice of $SiO_4$ tetrahedra, cross-linked by the sharing of oxygen atoms and which may optionally contain other atoms in the lattice, especially aluminum in the form of $AlO_4$ tetrahedra; the zeolite will also include a sufficient cationic complement to balance the negative charge on the lattice. Acidic functionality may, of course, be varied by artifices including base-exchange, steaming, acid extraction or control of silica-to-alumina ratio via synthesis conditions and/or the preceding methods or combinations thereof.

The original cations associated with each of the crystalline silicate zeolites utilized herein may be replaced by a wide variety of other cations, according to techniques well known in the art. Typical replacing cations including hydrogen, ammonium, alkyl ammonium and metal cations, including mixtures of the same. Of the replacing metallic cations, which are discussed more fully hereinafter, particular reference is given to noble metals, such as metals of Group VIII of the Periodic Table, e.g., platinum and palladium.

Typical ion-exchange techniques are to contact the particular zeolite with a salt of the desired replacing cation. Although a wide variety of salts can be employed, particular preference is given to chlorides, nitrates and sulfates. Representative ion-exchange techniques are disclosed in a wide variety of patents, including U.S. Pat. Nos. 3,140,249; 3,140,251; and 3,140,253.

Following contact with a solution of the desired replacing cation, the zeolite is then preferably washed with water and dried at a temperature ranging from 150° to about 600° F. (65°-315° C.), and thereafter calcined in air, or other inert gas, at temperatures ranging from about 500° to 1500° F. (260°-815° C.) for periods of time ranging from 1 to 48 hours or more. It has been further found that catalysts of improved selectivity and other beneficial properties may be obtained by subjecting the zeolite to treatment with steam at elevated temperatures ranging from 500° to 1200° F. (399°-538° C.), and preferably 750° to 1000° F. (260°-694° C.). The treatment may be accomplished in an atmosphere of 100% steam or an atmosphere consisting of steam and a gas which is substantially inert to the zeolites. A similar treatment can be accomplished at lower temperatures and elevated pressure, e.g., 350° to 700° F. (177°-371° C.) at 10 to about 200 atmospheres.

The crystalline silicate zeolite utilized in the process of this invention is desirably employed in intimate combination with a noble metal, such as platinum or platinum in combination with the Group VIII metals, e.g., platinum-rhenium or platinum-iridium, in an amount between 0.1 and about 25 wt %, normally 0.1 to 5 wt %, and preferably 0.3 to 3 wt %. Such component can be exchanged into the composition, impregnated thereon, or physically intimately admixed therewith. Such component can be impregnated into or onto the zeolite, such as, for example, in the case of platinum, by treating the zeolite with a platinum metal-containing ion. Thus, suitable platinum compounds include chloroplatinic acid, platinous chloride and various compounds containing the platinum amine complex.

The compounds of the useful platinum or other metals can be divided into compounds in which the metal is present in the cation of the compound and compounds in which it is present in the anion of the compound. Both types of compounds which contain the metal in the ionic state can be used. A solution in which platinum metals are in the form of a cation or cationic complex, e.g., $Pt(NH_3)Cl_2$, is particularly useful.

The process of this invention is concerned with the direct reforming of olefinic gasolines derived from catalytic cracking of gas oils by the FCC or TCC processes while simultaneously removing sulfur. Rapid aging of conventional reforming catalysts due to the relatively high sulfur content of these gasolines is avoided through the use of a novel catalyst prepared by steaming and acid dealuminization of a large pore zeolite catalyst, an example being the commercially available Linde Ultrastable Y zeolite, followed by impregnation with platinum as the tetraamine.

Process Conditions

The present invention is essentially a reforming process, in that the reactions which take place are reforming reactions. However, the process cannot be called a reforming process per se for the following reasons. The process of the present invention passes an olefinic-containing feed at a high temperature over the catalyst and directly cyclizes the olefins to aromatics. Additionally, the process increases the octane value and reduces the sulfur content of the olefinic-containing feedstock. Thus, unlike conventional reforming processes, the process of the present invention (1) accepts olefinic-containing feedstocks, (2) accepts sulfur-containing feedstocks, and (3) accepts feedstocks with a high boiling point, i.e., in excess of 350° F. (177° C.).

The feedstock is contacted with the catalyst in the presence of hydrogen under reforming conditions of elevated temperature and pressure. Conditions of temperature, pressure, space velocity and hydrogen ratio are similar to those used in conventional reforming processes. Temperatures of 600° to 1200° F. (300°-650° C.), more commonly 750° to 1000° F. (400°-540° C.), will be typical, as will be pressures from mildly superatmospheric up to 1435 psig, more commonly 100 to 250 psig, space velocities from 0.1 to 20 LHSV, more commonly 0.5 LHSV, and hydrogen circulation ratios of about 1125 to 5620 SCF/bbl.

The process may be conveniently operated in conventional equipment, i.e., in a series of reactors with inter-stage heating to maintain the desired reactions and heat balance. As noted previously, a particular advantage of the use of the high siliceous zeolite supports is that the need for acidity maintenance by chlorination, use of water co-feed and the like is substantially reduced and may, in favorable circumstances, be eliminated. Nonetheless, if experience demonstrates that the use of these conventional expedients is necessary or desirable, resort may be made to them. Thus, water may be fed in with the feedstock in conventional amounts, typically of 1 to 100 ppm, or halogenation may be used to maintain activity, for example, by incorporation of the halogen in the form of an acid or a salt or by addition of the halogen or halide compound during the reforming process itself, in a conventional manner. Chlorine is the preferred halogen. Details of the halogen activity maintenance methods may be found in U.S. Pat. Nos. 4,261,810; 4,049,539; 3,835,063; 6,661,768; and 3,649,524.

The invention is illustrated by the following examples, in which all parts, proportions and percentages are by weight, unless stated to the contrary.

EXAMPLE 1

The stable catalyst of the present invention may be prepared by steaming a large pore Y zeolite in its ammonium or hydrogen form. For example, a Linde Ultrastable Y, typically comprising 2.5 wt % Na, is suitable. Programmed steaming may be performed at 0.1 atmosphere steam/nitrogen mixture at about from 900° to about 1500° F. (482°-815° C.). The steamed catalyst is exchanged with $NH_4^+$ and acid extracted in 0.1 to 2.0 N HCl for 1 hour under reflux. Steaming at about 900° F. (482° C.) or above for 4 hours, followed by a second $NH_4^+$ exchange, will yield an intermediate suitable for impregnation. A solution of platinum (as the tetraamine)

was incorporated on the hydropobic support to incipient wetness. After calcining at 350° C. in air, the resultant novel catalyst product is obtained.

Analysis of the product shows a platinum content of 0.48 wt % of dealuminized Y zeolite having a silica-to-alumina ratio of 2600:1 (determined by MAS NMR). Such a dealuminized Y zeolite was analyzed and found to have a bulk $SiO_2/Al_2O_3$ ratio of 45, with an approximate framework, i.e., tetrahedral alumina, $SiO_2/Al_2O_3$ of 2600 by MAS NMR. The activity represented by the alpha value of this material was determined to be 1.5, in good agreement with the approximate framework aluminum content. The platinum loading determined to be 0.48% had a substantially uniform dispersion of 96%, as determined by hydrogen chemisorption.

An olefinic gasoline sample from FCC of Arab Light VGO, with a RON+0 of 91 and 2950 ppm sulfur, was distilled into three fractions and analyzed for octane number (RON) and sulfur. The analyses indicate that sulfur increases significantly with increasing boiling point, while the octane number decreases, as shown below.

TABLE 1

| | FCC Gasoline Properties | | | |
|---|---|---|---|---|
| Boiling Range, °F. | Full-Range | $C_5$-180 | 180-300 | 300-420 |
| Yield, Wt % | 100.0 | 41.0 | 34.3 | 24.3 |
| RON + 0[1] | 91.0 | 93.8 | 89.3 | 89.0 |
| Sulfur, ppmw | 2950 | 480 | 1850 | 7800 |
| Hydrogen, Wt % | 12.6 | 14.0 | 12.7 | 11.4 |

[1]Research Octane Number

The intermediate boiling range fraction (180°-300° F.) was used as the feed for contact with the novel catalyst of the present invention. Additional analyses indicated that this fraction is composed of 17% paraffins, 44% olefins, and 27% aromatics by weight. Process conditions of 900° F., 250 psig, 4.0 LHSV and about 4000 SCF/bbl hydrogen flow were used to simultaneously desulfurize and increase the octane rating of the olefinic FCC gasoline. For eighteen days prior to charging the FCC gasoline fraction, the dealuminized Y zeolite catalyst of the invention was used for reforming a number of conventional feeds.

Initial results show that about 83 wt % yield of 99 RON+0 gasoline is obtained when processing the 180° to 300° F. FCC gasoline fractions at the above conditions. Analysis shows that this product is composed of 25% paraffins, 0% olefins, 2% naphthenes, and 73% aromatics. At this reaction severity, it was estimated that a net hydrogen production of about 150 SCF/bbl was obtained. The product compositions and properties can be found in Table 2.

TABLE 2

| | Product Compositions and Properties | |
|---|---|---|
| | Feed | Product |
| Octane, RON + O | 89.3 | 98.6 |
| Sulfur, ppmw | 1850 | 1 |
| Paraffins, Wt % | 17 | 25 |
| Olefins | 44 | 0 |
| Naphthenes | 12 | 2 |
| Aromatics | 27 | 73 |

Essentially no catalyst aging was observed during six days of additional processing over sulfur-containing, olefinic FCC gasoline feed.

Comparing the yield and octane data suggests that similar overall results can be achieved directly by processing with the novel dealuminized Y zeolite catalyst of this invention, as can be obtained by conventional hydrotreating (HDT) followed by conventional reforming. In addition, the relatively low hydrogen content of the olefinic FCC gasolines suggest that the net endotherm encountered in conventional reforming could be reduced.

The present process, utilizing the novel concept, both increases the overall FCC gasoline pool octane and simultaneously reduces the level of sulfur. Direct processing of the intermediate and heavy FCC gasoline fractions using a process of the type is an attractive alternative to conventional hydrotreating/reforming or hydrodesulfurization of FCC feeds.

EXAMPLE 2

The catalyst utilized in Example 2 is the same catalyst described with respect to Example 1. The feedstock for Example 2 was a FCC gasoline which was distilled and cut at 180° and 300° F. Cut 2, i.e., the heart cut (180°-300° F.), and cut 3 (300° F.+) were used as feedstocks for the experiments. A complete analysis of the full range FCC gasoline and of the three cuts is given in Table 3.

TABLE 3

| | Analysis of FCC Gasoline | | | |
|---|---|---|---|---|
| | | Cut 1 | Cut 2 | Cut 3 |
| Fraction (As Cut) | Full-Range | I-180° F. | 180°-300° F. | 300° F. + |
| Yield, Vol. % | 100.0 | 39.0 | 40.2 | 20.8 |
| API Gravity | 54.7 | 77.8 | 50.6 | 31.0 |
| Hydrogen, Wt % | 13.14 | 15.08 | 12.99 | 11.21 |
| Sulfur, ppmw | 3000 | 400 | 2100 | 8400 |
| Nitrogen, ppmw | 60 | 12 | 37 | 160 |
| Paraffins, Wt % | 31.9 | 43.5 | 30.6 | 19.3 |
| Olefins | 22.8 | 29.2 | 16.3 | 8.4 |
| Naphthenes | 14.7 | 16.1 | 15.8 | 10.6 |
| Aromatics | 30.5 | 11.3 | 37.3 | 61.4 |
| RON + 0 | 89.9 | 92.5 | 88.0 | 90.0 |
| MON + 0[1] | 79.7 | 80.5 | — | — |
| RVP[2] | 5.15 | 11.22 | — | — |
| TBP, °F. | | | | |
| 5% | 76 | 77 | 150 | 315 |
| 50% | 247 | 136 | 261 | 393 |
| 95% | 446 | 236 | 362 | 488 |

[1]Motor Octane Number
[2]Reid Vapor Pressure

It is worth noting that cut 2 and cut 3 contain significant amounts of olefins (16% and 8%, respectively) and aromatics (37% and 61%, respectively). As a result, their octane is already high (88 and 90 RON+0). However, upon hydrotreating to remove the sulfur and nitrogen, the octane would drop considerably. Thus, the purpose of the present example is to find a way to maintain or even increase the level of octane while removing the sulfur and nitrogen.

At the beginning of the run, the novel catalyst was heated to 300° F. under hydrogen atmosphere, kept at that temperature for 2 hours, and then slowly heated to 660° F. at a rate of 90° F. per hour. The feed was started after the catalyst had been at 660° F. for 2 hours. The temperature was then increased to the desired reaction temperature. The catalyst ran for an initial period of 18 days processing a FCC gasoline heart cut (cut 2). The FCC gasoline heart cut (cut 2) was then added and maintained on-stream for 3 weeks at a temperature of 900° F. (482° C.) and a LHSV varying between 2 and 16. The feed was then changed to the heavy FCC gasoline fraction (cut 3) for a period of 2 weeks. The temperature varied between 900° and 950° F. (482°-510° C.) and the LHSV between 2 and 4. Although the fractions were processed separately, it is believed that the fractions may be coprocessed. The light olefinic fraction, which already had a high octane rating (92.5 RON) and a relatively low sulfur content (0.04 wt %), did not appear to need further upgrading, although it may be treated by conventional means to reduce mercaptans. The runs were compared with runs using a standard chlorided platinum or alumina reforming catalyst.

The results or processing the heart cut (cut 2) are illustrated in Table 4 below.

TABLE 4

Upgrading of FCC Gasoline 180°-300° F. Fraction

| Catalyst/Process | Feed | HDT[1]/REF Pt—Al | 0.5% Pt-USDY ZEOLITE[2] |
|---|---|---|---|
| Net $H_2$ Consumption, SCF/B | — | 108[3] | −146 |
| Yields and Properties, Wt % | | | |
| H | — | +0.6 | +0.3 |
| $H_2S + NH_3$ | — | 0.2 | 0.2 |
| $C_1$ | — | 2.1 | 0.1 |
| $C_2$ | — | 3.2 | 1.0 |
| $C_3$ | — | 8.1 | 6.3 |
| IC4[4], Vol % | — | 3.3 | 7.0 |
| NC4[5], Vol % | — | 6.4 | 7.2 |
| $C_5^+$ Gasoline, Vol % | 100.0 | 77.5 | 80.1 |
| RON + O | 88 | 98.2 | 98.5 |
| MON + O | — | 90.0 | 90.4 |
| RVP | — | (3.6) | 3.6 |
| Sulfur, ppmw | 2100 | 0.5 | 1.2 |
| Nitrogen, ppmw | 37 | 0.2 | 0.6 |
| Aromatics, Wt % | 37.3 | 47.5 | 50.3 |
| Olefins | 16.3 | 0.0 | 0.0 |
| Density at 60° F. | 0.7770 | 0.795 | 0.794 |

[1]Hydrotreating
[2]Process Conditions: 900° F., 250 psig, 4.0 LHSV, 4000 SCF/B $H_2$
[3]Includes HDT Consumption 400 SCF/B $H_2$
[4]Iso-butane
[5]Normal Butane Yields comparable to those achieved by conventional hydrotreating and reforming were obtained when processing the intermediate boiling range fraction, as illustrated in Table 4. It is worthy to note that the yield of iso-butane is considerably greater over the zeolite catalyst, mainly due to a reduction in light gas make, and is a potential source of additional alkylate. This reduction in light gas make could result in increased hydrogen purity in the recycle gas.

As illustrated in Table 5 below, processing the heavy FCC gasoline fraction appears particularly attractive.

TABLE 5

Upgrading of FCC Gasoline 300° F.+ (149° C.) Fraction

| Catalyst/Process | Feed | 0.5% Pt-USDY[1] Zeolite |
|---|---|---|
| Yields and Properties, Wt. % | | |
| $H_2$ | — | −0.8 |
| $H_2S + NH_3$ | — | 0.89 |
| $C_1$ | — | 0.2 |
| $C_2$ | — | 1.8 |
| $C_3$ | — | 4.4 |
| IC4, Vol % | — | 3.1 |
| NC4, Vol % | — | 5.4 |
| $C_5^+$ Gasoline, Vol % | 100.0 | 88.4 |
| RON + O | 90.0 | 103.3 |
| MON + O | — | 93.7 |
| RVP | — | 2.6 |
| Sulfur, ppmw | 8400 | 3.5 |
| Nitrogen, ppmw | 160 | 1.3 |
| Aromatics, Wt % | 61.4 | 72.6 |
| Olefins | 8.4 | 0.0 |

TABLE 5-continued

Upgrading of FCC Gasoline 300° F.+ (149° C.) Fraction

| Catalyst/Process | Feed | 0.5% Pt-USDY[1] Zeolite |
|---|---|---|
| Density at 60° F. | 0.8706 | 0.858 |

[1]Process Conditions: 900° F., 250 psig, 2.0 LHSV, 4000 SCF/B $H_2$

The heavy FCC gasoline fraction is presently hydrotreated in a number of refineries to remove sulfur. Both the high sulfur level of about 8000 ppm and high end point of about 450° F. (232° C.) preclude conventional hydrotreating/reforming. The results here indicate that net gasoline yields on this fraction, approaching 97 vol %, could be achieved with an octane gain of about 13 RON and a reduction of sulfur in the product to less than 10 ppm.

Combining the processed fractions with the untreated olefinic light gasoline results in a significant gain in overall FCC gasoline octane, with minimal loss of yield. As disclosed in Table 6 below, it is estimated that about 90 vol % yield of $C_5$+ gasoline could be obtained with an octane gain of 7 RON and a reduction of sulfur from 0.30 wt % to less than 0.02 wt %. The olefin content of the gasoline is substantially reduced, with an increase in aromatics.

TABLE 6

Overall Estimated Yields and Gasoline Properties

| | Joliet FCC Gasoline | Net Product[1] | Δ |
|---|---|---|---|
| $H_2$, Wt % | — | −0.07 | |
| $H_2S$, Wt % | — | 0.305 | |
| $NH_3$, Wt % | — | −0.007 | |
| $C_1$, Wt % | — | 0.05 | |
| $C_2$, Wt % | — | 0.84 | |
| $C_3$, Wt % | — | 3.65 | |
| IC4, Vol % | — | 3.48 | +3.5 |
| NC4, Vol % | — | 4.02 | +4.0 |
| $C_5^+$ Gasoline, Vol % | 100 | 89.9 | −9.1 |
| $C_5^+$ Properties | | | |
| RON + 0 | 89.9 | 97.0 | +7.1 |
| MON + 0 | 79.7 | 86.6 | +9.9 |
| RVP + 0 | 5.15 | 6.70 | |
| Sulfur, Wt % | 0.300 | 0.016[2] | |
| Nitrogen, ppmw | 60 | 6 | |
| Aromatics | 30.5 | 49.4 | |
| Olefins | 22.8 | 11.3 | |

[1]Linear blending of untreated light FCC gasoline and processed intermediate and heavy fractions
[2]Lower if olefinic light gasoline Merox treated Thus, the present process offers the potential for both increasing the overall FCC gasoline pool octane and reducing the level of sulfur. Direct processing of the intermediate and heavy FCC gasoline fractions using a process of this type could be an attractive alternative to conventional hydrotreating/reforming or hydrodesulfurization of FCC feeds. Further, by the process of the present invention, the catalyst can operate in the presence of a higher level of sulfur without any significant aging of the catalyst. The conventional reforming processes can tolerate olefins in the feed which generally tend to coke very rapidly over conventional catalysts at reforming conditions. The net result of this process is a high octane gasoline that is low in sulfur with a minimal loss of yield.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

We claim:

1. A process for producing a gasoline of reduced sulfur content, comprising:

contacting a catalytically cracked olefinic gasoline having an initial boiling point of at least 180° F. and an initial sulfur content of at least 50 ppm and containing an initial content of olefins and aromatics and having an initial octane number with a catalyst composition comprising a nobel metal component and a large pore zeolite having a framework silica:alumina ratio of at least 50, at a temperature from 750° F. to 1200° F., an elevated pressure up to 1435 psig and a space velocity (LHSV) of 0.1 to 20, to reduce the olefinic content of the gasoline while reducing its sulfur content to a value below the initial sulfur content without reducing the initial octane number and increasing the content of aromatics to a value above that of the initial aromatics content, and recovering a gasoline having a sulfur content having a sulfur content lower than the initial sulfur content, an olefins content lower than the initial olefins content, and an aromatics content which exceeds the initial aromatics content.

2. The process of claim 1, wherein the feedstock has an end point of up to about 350° F.

3. The process of claim 2, wherein the feedstock has an end point of up to about 300° F.

4. The process of claim 1, wherein said zeolite has a framework $SiO_2/Al_2O_3$ ratio of greater than 500:1.

5. The process of claim 1, wherein the zeolite is zeolite Y.

6. The process of claim 5, wherein the zeolite is dealuminized zeolite Y.

7. The process of claim 1, wherein the zeolite is zeolite USY.

8. The process of claim 1, wherein the noble metal component is platinum.

9. The process of claim 1, wherein the nobel metal component is platinum in combination with another Group VIII metal other than platinum, rhenium or iridium.

10. The process of claim 11, wherein the olefinic gasoline is contacted in the presence of hydrogen with the catalyst at a temperature from about 750° to 1000° F., a pressure from about 100 to about 500 psig, and LHSV from about 2 to about 16.

11. The process of claim 10, wherein said noble metal component is platinum.

12. The process of claim 1, wherein the olefinic gasoline is contacted with the catalyst in the presence of hydrogen at a hydrogen circulation ratios of from about 1125 to 5620 SCF/bbl.

13. A process for producing a gasoline of reduced sulfur content, comprising:

(i) catalytically cracking a hydrocarbon feedstock to produce a catalytically cracked olefinic gasoline, (ii) fractionating the catalytically cracked olefinic gasoline to produce a first, low boiling gasoline fraction and a second, higher boiling gasoline fraction having an initial boiling point of at least 180° F., an initial sulfur content of at least 50 ppm and containing an initial content of olefins and aromatics and having an initial octane number, (iii) contacting the second gasoline freaction with a catalyst composition comprising a noble metal component and a large pore zeolite having a framework silica:alumina ratio of at least 50, at a temperature from 750° F. to 1200° F., an elevated pressure up to 1435 psig and a space velocity (LHSV) of 0.1 to 20, to reduce the olefinic content of the second gasoline fraction while reducing its sulfur content to a value below the initial sulfur content without reducing the initial octane number and increasing the content of aromatics to a value above that of the initial aromatics content, to form a treated second gasoline fraction having a sulfur content having a sulfur content lower than the initial sulfur content, an olefins content lower than the initial olefins content, and an aromatics content which exceeds the initial aromatics content, (iv) blending the treated second gasoline fraction with the lower boiling gasoline fraction to produce a low sulfur gasoline product of improved octane rating and reduced olefin content.

14. The process of claim 13, wherein the feedstock has an end point of up to about 350° F.

15. The process of claim 12, wherein the feedstock has an end point of up to about 300° F.

16. The process of claim 12, wherein said zeolite has a framework $SiO_2/Al_2O_3$ ratio of greater than 500:1.

17. The process of claim 12, wherein the zeolite is zeolite Y.

18. The process of claim 17, wherein the zeolite is dealuminized zeolite Y or zeolite USY.

19. The process of claim 12, wherein the noble metal component is platinum.

20. The process of claim 12, wherein the olefinic gasoline is contacted in the presence of hydrogen with the catalyst at a temperature from about 700° to 1000° F., a pressure from about 100 to about 500 psig, and LHSV from about 2 to about 16.

* * * * *